US007789520B2

(12) United States Patent
Konig et al.

(10) Patent No.: US 7,789,520 B2
(45) Date of Patent: Sep. 7, 2010

(54) ELECTROLUMINESCENT COMMUNICATION SYSTEM BETWEEN ARTICLES OF APPAREL AND THE LIKE

(76) Inventors: Kristian Konig, 155 Centre Ave., New Rochelle, NY (US) 10805; Marcel Konig, 155 Centre Ave., New Rochelle, NY (US) 10805

( * ) Notice: Subject to any disclaimer, the term of this patent is extended or adjusted under 35 U.S.C. 154(b) by 414 days.

(21) Appl. No.: 11/899,978

(22) Filed: Sep. 7, 2007

(65) Prior Publication Data

US 2008/0062677 A1 Mar. 13, 2008

Related U.S. Application Data

(60) Provisional application No. 60/843,283, filed on Sep. 8, 2006.

(51) Int. Cl.
*F21V 33/00* (2006.01)

(52) U.S. Cl. ..... 362/103; 362/84

(58) Field of Classification Search ..... 362/103
See application file for complete search history.

(56) References Cited

U.S. PATENT DOCUMENTS

| | | | | |
|---|---|---|---|---|
| 5,485,355 | A * | 1/1996 | Voskoboinik et al. | 362/84 |
| 5,794,366 | A * | 8/1998 | Chien | 40/540 |
| 5,860,727 | A * | 1/1999 | Chien | 362/84 |
| 5,955,957 | A * | 9/1999 | Calabrese et al. | 340/691.8 |
| 6,030,089 | A * | 2/2000 | Parker et al. | 362/103 |
| 6,082,867 | A * | 7/2000 | Chien | 362/84 |
| 6,624,568 | B2 * | 9/2003 | Silvernail | 313/504 |
| 6,843,578 | B1 * | 1/2005 | Cheung | 362/103 |
| 6,874,904 | B2 * | 4/2005 | Hsu | 362/84 |
| 6,976,762 | B2 * | 12/2005 | Chien | 362/84 |
| 7,030,855 | B2 * | 4/2006 | Metcalf | 345/108 |
| 7,592,276 | B2 * | 9/2009 | Hill et al. | 442/301 |
| 7,607,243 | B2 * | 10/2009 | Berner et al. | 36/136 |
| 7,631,382 | B2 * | 12/2009 | DiBenedetto et al. | 12/142 P |
| 2001/0024364 | A1 * | 9/2001 | Hurwitz | 362/84 |
| 2001/0036074 | A1 * | 11/2001 | Wang | 362/156 |
| 2004/0103563 | A1 * | 6/2004 | Linge | 36/137 |
| 2004/0145089 | A1 * | 7/2004 | Burrows | 264/496 |
| 2004/0255490 | A1 * | 12/2004 | Wan et al. | 36/137 |
| 2005/0207138 | A1 * | 9/2005 | Cheung | 362/84 |
| 2005/0243541 | A1 * | 11/2005 | Sibbett | 362/106 |
| 2006/0101674 | A1 * | 5/2006 | Ungari | 36/137 |
| 2006/0198121 | A1 * | 9/2006 | Thorpe et al. | 362/103 |
| 2007/0028486 | A1 * | 2/2007 | Montanya et al. | 36/137 |

* cited by examiner

*Primary Examiner*—Jong-Suk (James) Lee
*Assistant Examiner*—Leah S Lovell
(74) *Attorney, Agent, or Firm*—Thomas A. O'Rourke; Bodner & O'Rourke, LLP

(57) ABSTRACT

An article of apparel, or household fabric, having a power source, a switch and at least one electroluminescent or fabric strip for illuminating the article of apparel, or household article. In addition, the present invention can be used in a peer to peer network. The article may have a communication system including a transmitter and a receiver. Furthermore, the present invention can have electric circuitry that can be integrated with the electrical components so as to create different visual effects in response to signals from the communication system. The electroluminescent strips of the present invention can be designed to follow the contour of a trademark, logo, or character. Also, the electroluminescent strips can be designed to follow the stitching of the sneaker and follow the sneaker lace path. Switches of the present invention can include, preferably, a toggle switch, or if desired a pressure switch, a reed switch, or the like. The power source implemented is preferably a rechargeable battery.

34 Claims, 3 Drawing Sheets

ELECTROLUMINESCENT COMMUNICATION SYSTEM BETWEEN ARTICLES OF APPAREL AND THE LIKE

The present invention claims priority from previously filed Provisional Patent Application No. 60/843,283, filed on Sep. 8, 2006 the disclosures of which are incorporated herein by reference.

FIELD OF INVENTION

The present invention relates to a communication system that transmits signals from one article to a second article. The communication system may be a traditional network with a base station and one or more nodes that are in communication with the base station. Alternatively, there may be a peer to peer or ad hoc communication system in which one or more transmitter/receivers communicate with other transmitter/receivers. More particularly, the present invention relates to a communication system between an article of clothing and one or more other articles of clothing. The present invention also includes communication between a variety of apparel, drapes, sheets, curtains, or any other object, and more particularly, to footwear. In the preferred embodiment the communication system includes preferably at least one array of light sources such as electroluminescent (EL) light strips or an electroluminescent fabric. The may be at least one switch means which is operative to activate the EL.

BACKGROUND OF INVENTION

Although the present invention may be used with any type apparatus including but not limited to phones, MP3 type players, pda's, etc., the invention has particular applications when used with all types of apparel. The present invention has particular utility with footwear, more particularly athletic shoes. An athletic shoe is a generic name for a shoe designed for sporting activities, as differentiated from, for instance, dress shoes, today they are worn much more widely as casual footwear, more commonly known in the art as sneakers.

The first sneaker was invented back in 1893. It was made of canvas and was invented so boaters would not have to wear dress shoes when they were on deck. In 1916 the United States Rubber company first coined the term sneaker for their Keds brand, because the rubber soles made the shoes quiet. Since then, the sneaker has become an important part of contemporary youth fashion.

Sneakers that are worn casually are made with a more simple "retro" design which is made to be more aesthetically pleasing than sneakers specifically designed for sports or exercise. Ironically enough, however, sneakers that were once designed for athletic purposes are now more commonly used for fashion. Examples include Converse's Chuck Taylor All Star, Nike's Air Jordan, which were designed for basketball and Adidas' Samba, a soccer boot created for indoor soccer.

Today, sneaker sales gross in the hundreds of millions every year, with toddlers and teenagers being the target demographic. In order to gain the edge in the sneaker market, manufactures for years have been designing sneakers with many different features. Some of the more recent features, in the last fifty years, have included: sneakers with high tops, sneakers with pumps, sneakers with roller balls in their heels and sneakers with lights. The present invention relates to the latter, sneakers with lights.

For a number of years, articles of footwear and various items of clothing have been sold with decorative arrays of light sources such as light emitting diodes (LEDs), electroluminescent (EL) light strips, and/or a loudspeaker capable of producing a sound. This has been particularly popular in children's shoes where the LEDs are arranged to complement other design elements of the shoe such as cartoon characters, logos, trademarks and the like.

Sneakers having various types of lighting devices incorporated therein are well known in the art. Lighting devices have been incorporated into a variety of footwear, including but not limited to dress shoes, athletic shoes, boots, sandals and the like. The inclusion of lighting devices in footwear has been utilized for a number of reasons including permitting the wearer to see or be seen in reduced light situations; to provide special effects during entertainment events; or as an element of fashion on the part of the wearer.

Prior art, such as U.S. Pat. No. 7,096,607, issued to Guzman, includes an article of clothing having an electrical circuit, a battery, one or more integrated circuits connected to a signal device such as an array of LEDs and/or a loudspeaker, and, at least one switch which is operative to activate the integrated circuit(s) in response to the application of a magnetic field to the switch from a permanent magnet located externally of the article of clothing.

Other prior art, such as United States Published Patent Application 2006/0002134, invented by Capriola, includes fiber optic cable, a clasp and a control circuit. The illuminating device is optically coupled to one or both of the connectors in order to illuminate at least a portion of the fiber optic cable with light. At least one of the clasp and illuminating device is removable to permit interchangeable selectivity of the color of the illuminating light.

Other prior art, such as U.S. Pat. No. 7,059,070, issued to Omstead et al. Provides, illuminated footwear including a translucent sole insert housing LEDs, preferably of different colors which may be combined to produce a wide array of colors is provided. The heel similarly includes a translucent insert and includes an interior mirror material and an illumination source. An on/off switch in the toe of the footwear is connected in a circuit with a replaceable battery, a control processor and the LEDs. The control processor includes logic that may dim, strobe, or shut off all or some of the LEDs. In operation, when the device is activated, the LEDs are illuminated. The light from the individual LEDs is blended and reflected by the interior mirror materials in an outward direction from the shoe. The translucent material in the sole and heel of the shoe allows the blended light to pass through to create a pleasing visual effect.

Typically, a module including a plastic housing is placed in a cavity usually formed in the heel area of the shoe. The module mounts a battery, a switch and conventionally an integrated circuit which is connected by wires to LEDs, EL light strips and the like, are positioned along the outsole, upper portion or tongue of the shoe. The integrated circuit may also be capable of generating a signal which operates a loudspeaker, typically mounted in the upper or tongue of the shoe in the general area of the LEDs. Systems of this type are shown, for example, in U.S. Pat. Nos. 6,525,487; 6,286,975; 6,012,822; 5,969,479; 5,894,201; 5,812,063 and others.

The integrated circuits employed in modules for footwear and other applications are activated by the switch associated with the module. In most designs, the switch is not operated manually but turns on and off in response to the application of an inertial force, pressure or motion. Spring switches such as shown in U.S. Pat. Nos. RE 37,220 and 5,909,088 are a popular choice for children's shoes because they are reliable, noiseless and movable from a neutral or off position to a closed or on position in response to walking, running or other motion of the shoe. Pressure switches such as shown in U.S.

Pat. Nos. 5,159,768; 5,649,376; 5,855,080 and 5,714,706 are also employed and they operate in response to the application of a weight, e.g. when the child steps onto a surface.

Another type of switch employed in children's shoes and similar applications is a magnetically activated switch such as shown in U.S. Pat. Nos. 5,422,628 and 5,343,190. In these designs, a reed switch and a permanent magnet are mounted within the heel or other area of the shoe. The magnet is movable between a first position where it is spaced from the reed switch and a second position close to the reed switch. A spring normally biases the magnet to the first position, but when motion or an inertial force is applied to the shoe, the magnet overcomes the spring force and moves to the second position where its magnetic field causes the reed switch to close.

In the present garment market there is a need for a garment that can be illuminated so as to highlight different areas of the garment in a cost effective manner.

OBJECTS OF THE INVENTION

A primary object of the present invention is to provide a communication system from a first base to a second base.

Also an object of the invention is a peer to peer communication system that permits articles to communicate with each other when they are in a selected range and in which they acknowledge communication by means of a visual signal.

Another object of the invention is to provide a communication system that has at least a mobile transmitter and is either carried or worn by a first person and which contains a corresponding receiver that is mobile and is either carried or worn by a second person.

It is a further object of the invention to provide a communication system that only transmits to receivers within a limited range.

It is a further object of the invention to provide a communication system whereby a preset message may be transmitted to a receiver in the limited range.

It is a still further object of the invention to provide a communication system whereby there is a visual signal issued by a receiver and a transmitter when the two are in communication with each other.

It is another object of the invention to provide a communication system where the transmitter and receiver are contained in an article of clothing.

It is a further object of the invention to provide a communication system where at least a portion of the article of clothing is illuminated when the transmitter and receiver are communicating with each other Another object of the present invention is to provide footwear illuminated by one or more electro-luminescent (EL) panels.

Another object of the present invention is to provide electro-luminescent footwear that is activated when a first transmitter is in communication with a receiver in another article of footwear.

It is still another object of the invention to provide an article of clothing with an electroluminescent source of light contained therein which is illuminated when a signal is received from a transmitter.

Still another object of the present invention is to provide electroluminescent footwear wherein there is a switch that may be enabled and disabled manually or in response to movement or pressure.

Yet another object of the present invention is to provide electroluminescent footwear having a plurality of EL panels or sheets contiguous to the surface area of the shoe and randomly illuminated by a random motion switch or random pressure switch in response to actions performed by the wearer of the shoe.

Still yet another object of the present invention is to provide electroluminescent footwear having a plurality of EL panels or sheets contiguous to the surface area of the shoe and randomly illuminated by a performed by another shoe in the vicinity of the first shoe.

Still yet another object of the present invention is to provide electroluminescent footwear having a series of EL panels having graphic design thereon that when lit in series simulate the motion or animation thereof.

Yet another object of the present invention is to provide electroluminescent footwear that is inexpensive to manufacture and operate.

Still yet another object of the present invention is to provide electro-luminescent footwear wherein the electro-luminescent strips are stitched into the body of the footwear.

One more object of the present invention is to provide electro-luminescent clothing or footwear that is simple to use.

These and other objects of the present invention will become apparent to those skilled in the art from a review from the description provided below.

SUMMARY OF THE INVENTION

The present invention includes footwear that can be illuminated manually by the wearer, or automatically by a computing means. Although prior art includes sneakers that can be illuminated, none to date include any one or more of the following features: a toggle switch located near the rear end of the sneaker or a mean for communicating from one article of clothing such as a sneaker to another article of clothing such as another sneaker.

The communication system of the present invention may be present in an article of clothing. There may be a transmitter and a receiver. Software programmed into the system will permit the sneaker to send and receive data. When this happens, the electroluminescent fabric or strip will be activated. The electroluminescent fabric or strip can be made to illuminate in a variety of patterns using the software. In one embodiment, the illumination will be based on similarities in user profiles. In another, the illumination can be caused by receiving a signal from another similar article on the network. The battery is preferably a rechargeable battery. In one embodiment, there may be a series of ports on the sneaker. One of the ports could be a charging port for the battery. Another port could be a USB, Firewire or similar data port for uploading and downloading data. The articles of the present invention will have the ability to switch from an ad hoc mode to an infrastructure mode and vice versa.

The articles will automatically search for other articles in the network at intervals which may be regular or irregular. The articles can receive and transmit a variety of data including but not limited to personal, business, advertising, classified, recreational, etc. The user can upload the data to a computer system from the article. Alternatively, the user can view the uploaded data at a custom website. In one embodiment the user can customize to his needs/standards on a daily basis.

Although the communication system of the present invention can employ a central base station and one or more nodes in communication therewith, in a preferred embodiment, the network of the present invention permits devices or stations to communicate directly with each other without the use of an access point or a central base station. The preferred network is an ad hoc network i.e. a peer to peer network. The article of the present invention may have a switch for communicating in a peer to peer mode or in a central base station mode Although the present invention can be activated via any number of complex switches as in the above cited prior art. The present invention implements a simple toggle switch that can be activated with the simple flick of the finger. Once the system is activated, the system can communicate with other receivers in the vicinity. These receivers can be on or incorporated in other articles of clothing. Preferably, the transmitters and receivers are incorporated into shoes and most preferably sneakers.

The present invention can have a remote bypass that gives the user the capability to bypass either, or both computing means. Furthermore, the present invention can be affixed to almost any fabric, such as Lumalive, or any object.

As mentioned above, the present invention can include at least one computing means. This computing means can store information about the user and create a profile. The profile can include information pertaining to the user's interests and/or likes. The present invention can also include a communication means. The communication means can implement the technology similar to the widely used WiFi. The communication means preferably is worn or carried by a user. Each communication means includes at least one transmitter preferably a transmitter and a receiver. With this embodiment if two or more users have similar profiles, then the apparel containing the profiles can be programmed to activate when the users come within range of each other. Preferably, the range may be relatively close so that there may be interaction between the users of the system. The communication system may also have the ability to "hop" signals if there are a multitude of users in the area in order to reach other devices.

As mentioned previously the present invention can be incorporated into just about any type of article of apparel. For example, the present invention can be attached to jeans, jackets, and home apparels such as drapes, cushions, or sofa coverings. The textiles that these garments and apparels can be manufactured from can include denim, leather, suede, cotton, and the like. The present invention can also be incorporated into other less commonly known textiles too. For example, light emitting textiles have utility with the present invention. One light emitting textile that that has utility with the present invention is sold under the trademark name Lumalive, developed by Philips. In one embodiment, as will be discussed below, one can use the present invention to accentuate exterior features such as house numbers and the like.

Aside from the obvious fanciful applications of the present invention, the present invention can be implemented in an array of practicable applications. For example, the present invention can be integrated into runner and cyclist vests to alert drivers to their presence.

DETAILED DESCRIPTION

Figure 1:
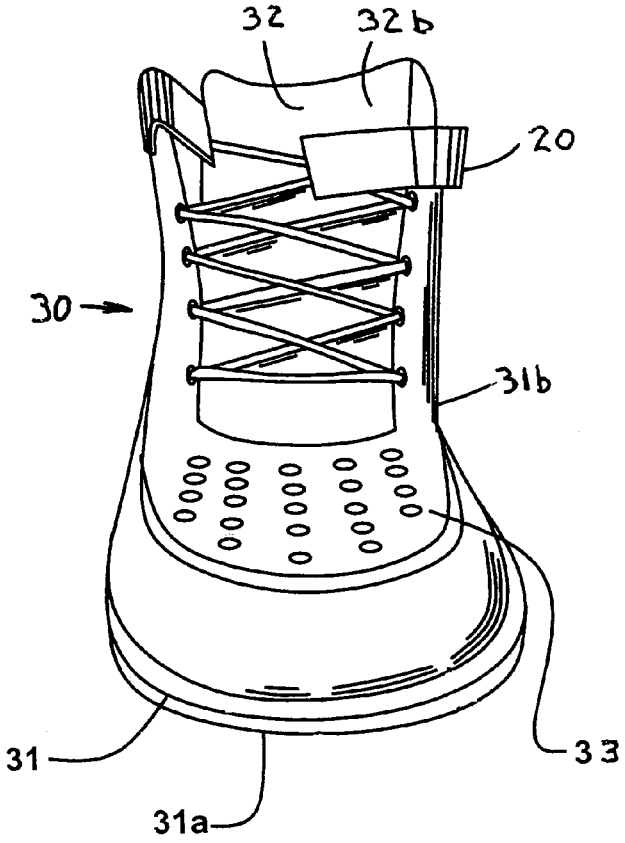
FIG. 1 is a front view of one embodiment of the present invention with the electroluminescent strips threaded through the sneaker lace holes.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

All cited references are incorporated herein by reference in their entireties. Citation of any reference is not an admission regarding any determination as to its availability as prior art to the claimed invention.

Turning now descriptively to the drawings, in which similar reference characters denote similar elements throughout the several views, the figures illustrate the present invention.

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

As mentioned previously the present invention can be incorporated into just about any type of article, however, it is preferably incorporated into articles of clothing and in particular shoes. When the article has a fabric the article is preferably manufactured from light emitting textiles such as Lumalive sold by Phillips.

The present invention is directed to a peer to peer communication system between these articles that incorporates in its most general form a first communication base having a transmitter and a receiver. There may be an antenna for assisting in receiving the signal. Connected to the transmitter and the receiver is a power source such as battery to power the transmitter and receiver. The transmitter periodically sends out a signal to other transmitter/receivers in a network. When the transmitter/receiver comes into communication with another transmitter/receiver, the transmitter/receiver preferably issues a signal to cause a visual display to commence signaling that two communication bases are in communication. The communication bases may be carried or worn by a user. In one preferred embodiment, the communication base is in an article of clothing, such as a shoe. In such instances, when the shoe of one user is in range of the shoe of another user, the shoes give off a visual signal preferably in the form of a light display. When the communication bases are in communication, there may be a transmission of messages between the two bases. A user can preselect a transmitted message prior to coming into range of a transmitter/receiver or in the alternative there can be real time preparation of a message followed by transmission to a recipient. The messages can be prepared using a keyboard that may be connected to the transmitter/receiver or preferably removably connected thereto. In another embodiment, the user can create a webpage on a custom website and a simple identification number to his/her webpage will be exchanged to all passing devices so that the users can collect store, upload and view the offerings of all the people connected to the network.

The present invention can be used in a variety of situations. One preferred use of the invention is in a nightclub or similar setting where the transmission of communication signals, particularly the visual light display, can be used as a means of introduction or as a means to facilitate meeting people who similarly have a transmitter/receiver.

FIG. 1 shows a representation of one embodiment of the present invention where the transmitter/receiver is in an article of clothing. In this example, the article of clothing is a sneaker 30. It will be appreciated that a variety of articles may be used in its place. The present invention utilizes electroluminescent (hereinafter EL) light strips 20 for various display effects. EL light strips 20 can be used to create many different colors and shapes. In addition, various decorations and graphic elements can be glued to the surface as well as printed. The EL strips 20 can be formed into various shapes, including thin strips, and to then be removably or permanently affixed to articles of clothing or footwear.

Figure 2:
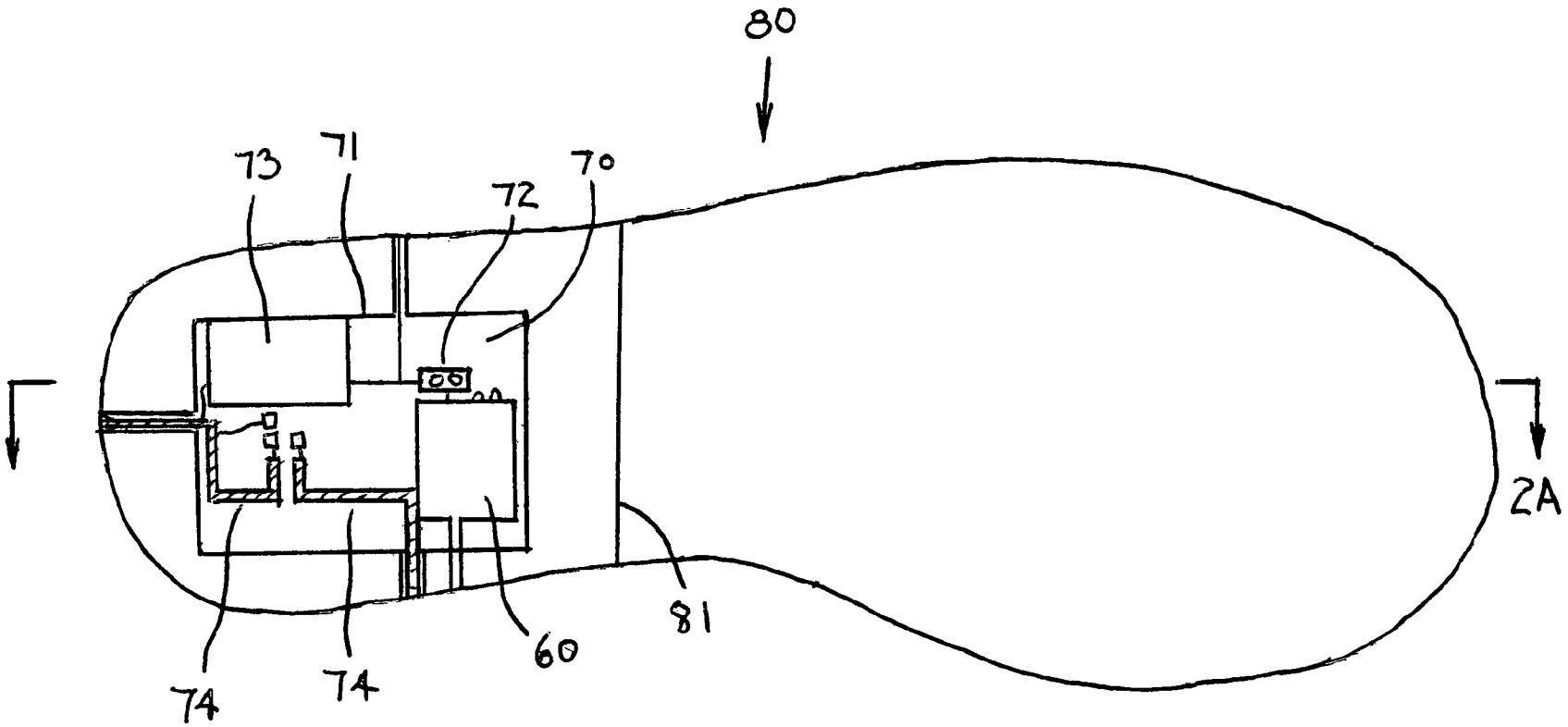
FIG. 2 is a drawing showing the communication system in a shoe or sneaker.
Figure 3:
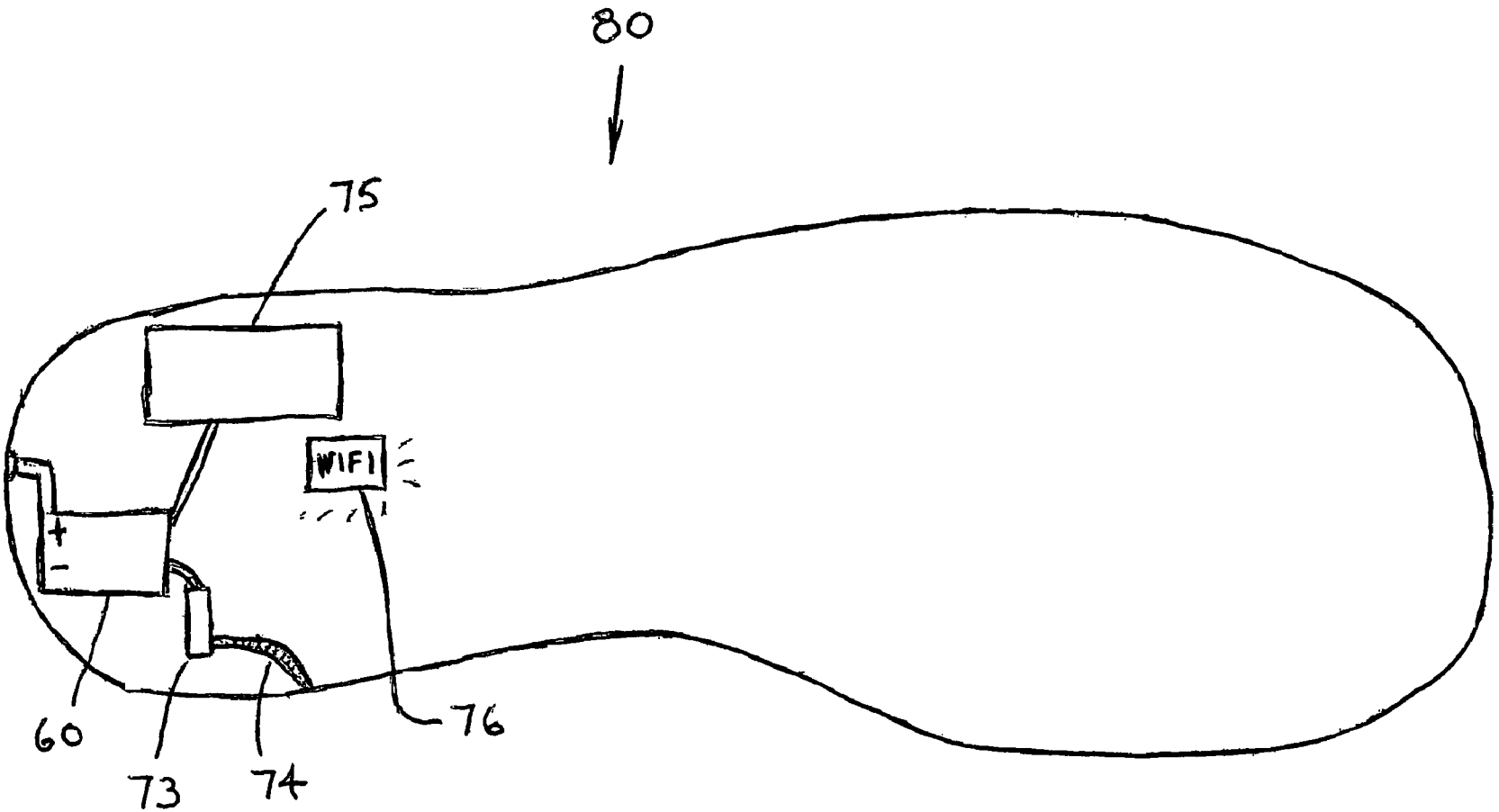
FIG. 3 is a drawing showing an alternative embodiment of the communication system.

In a preferred embodiment there can be a shoe or sneaker, and circuitry comprising at least one EL light strip 20, a switch 40 for controlling EL strip 20 and a power source 60. FIGS. 1-3 illustrate a preferred embodiment of the present invention. Sneaker 30 can have a base 31, which is commonly called a "sole" within the shoe industry, and a body 33, which is commonly referred to as the "upper." Base 31, may have a front end 31*a*, a rear end 31*b*. As previously mentioned, although a sneaker was used to be illustrative, the present invention can be used with any type of apparel. For example, it may be used with ice skates, roller blades, roller skates, and shoes with wheels, such as the type that go by the trademark name "Heelys" and the like. In addition, the present invention can be designed to operate with sporting equipment, including, but not limited to, skateboards, surfboards, snowboards and the like. The present invention, when incorporated into the aforementioned articles of apparel, can be designed to activate when the article is used. For example, if the present invention were to be incorporated into Heelys, the accentuated items on the Heelys can be designed to activate when the user begins to "Heely."

Located on base 31 there can be trademarks, logos and the like. Also, located on base 31 near front end 31*a* there can be grooves, slots and indents, used primarily for aesthetic purposes. Base 31 can have a generally foot like shape, as seen in FIG. 1, however any suitable shape known in the art can be used. Located at the top edge of base 31 there can be stitching that can be used to attach body 33 to base 31. Body 33 can have a single layer or multiple layers. This will depend on the manufacturer's desires. In the preferred embodiment, body 33 had an outer surface 33*o*, an intermediate or middle substrate layer 33*m* and a first inside substrate lining 33*i*.

Body 33 can also have a tongue 32, which extends upward from body 33, as seen in FIG. 1. Tongue 32 operates in generally the same manner as other prior art sneaker tongues in the market. That is, tongue 32 allows a user to insert and remove the foot of the user with ease. In the preferred embodiment tongue 32 can be constructed the same as body 33 with layers 33*o*, 33*m*, and 33*i*. A unique feature of the present invention is that tongue 32 can house circuitry, including power source 60, switch 40 or any combination thereof, located between the substrate layers.

Switch 40 can be located anywhere on sneaker 30. Switch 40 may be any suitable switch known in the available art, including, but not limited to toggle switches, reed switches and the like. In a preferred embodiment a single throw toggle switch 40 was implemented. Switch 40 operates similarly to other switches in the known art. That is, switch 40 can be connected in series with power source 60 and EL strip 20. Thus, when switch 40 is toggled from an "off" position, an open circuit, to an "on" position, a closed circuit, current will flow and illuminate EL strip 20.

Switch 40 can be attached to body 33 [31*d*] or base 31 by any suitable means known in the available market. In the preferred embodiment switch 40 can be threaded through an aperture 43. Generally, switch 40 is secured in place via a bolt.

In one embodiment switch 40 can have a wire extends from outside surface 33*o* to inside lining 33*i*. Inside lining 33*i* may be any suitable material known in the available art, including, but not limited to polyester, cotton, nylon and the like. In addition, inside lining 33*i* can have a cushion between it and outside surface 33*o*. The cushion can be any suitable material in the known art, including, but not limited to foam, cotton and the like. In a preferred embodiment, the cushion was manufactured from foam. Generally, sneaker manufacturers will use a soft, breathable, durable fabric, for inside lining 33*i*, as in the preferred embodiment. In the preferred embodiment outside surface 33*o* can be manufactured from any suitable material known in the art, including, but not limited to leather, canvas, suede and the like. In a preferred embodiment outside surface 33*o* was constructed from leather.

Also, it should be pointed out that in the preferred embodiment switch 40 is not controlled by the interaction between the ground and the sneaker. That is, switch 40 will remain in either an activated position or an inactivated position, unless it is manually changed from either of these positions. This differs from the cited prior art in that the above cited prior art automatically flickered on and off upon contact between the ground and sneaker.

In yet another embodiment, the circuitry can be controlled via a reed switch and a permanent magnet that can be mounted within the heel or other area of the shoe. The magnet is movable between a first position where it is spaced from the reed switch and a second position close to the reed switch. A spring normally biases the magnet to the first position, but when motion or an inertial force is applied to the shoe, the magnet overcomes the spring force and moves to the second position where its magnetic field causes the reed switch to close.

As mentioned above, in one embodiment tongue 32 can house the circuitry components. In this embodiment the circuitry can be permanently sealed, via stitching, or the like. In another embodiment, the circuitry can remain accessible to the user. With this embodiment, the circuitry can be an accessed via a slit, cavity, or the like that can be opened and closed by the user. To facilitate the opening and closing, one can implement a Velcro strip, a button, or any other suitable method that allows access.

In the preferred embodiment, the circuitry can be placed between intermediate layer 33*m* and inside lining 33*i*. In the preferred embodiment the user can gain access to the circuitry by simply lifting up lining 33*o*. In yet another embodiment, the circuitry can be housed within the heel or other area of the shoe.

As mentioned above, the present invention includes at least one EL strip 20. In the preferred embodiment there can be two EL strips. These strips are common in the known art and operate accordingly. That is, the EL strips are connected to a power source and when energized the EL strips illuminate. EL strips 20 can be any suitable color in the known art, including, but not limited to red, orange, yellow, blue, green, indigo, violet, or any combination thereof. In the preferred embodiment two EL strips were used, one orange and one white. When these strips are illuminated they appear pink and light blue, respectively.

With the many different designs that are featured on footwear, such as trademarks, logos and the like, it would be an arduous task to list all the different configurations that the EL strips can be conformed to take. So, for illustrative purposes only, one will discuss the present invention with reference to the embodiment depicted in the drawing labeled FIG. 1.

Most footwear, especially sneakers, have stitching that is used to attach a design, a character, a logo, a trademark, or the like to the outer surface of the footwear. These attachments are generally elevated above the outside surface of the footwear. EL strips 20 are stitched to the stitching of sneaker. Any suitable type of thread can be used to attach EL strips 20 to sneaker 30, including, but not limited to nylon thread, as in the present invention, cotton thread, or the like.

In normal operation, when the user wishes to illuminate EL strip 20, whether for safety reasons, or just to stand out in the crowd, the user will flip switch 20 to the on position. This will allow current to flow through EL strips 20, thus illuminating strips 20. The EL strips, of the present invention, can be designed to follow the contours of any kind of stitching included in the manufacture of the sneaker. If an alternative embodiment is implemented, say the embodiment that implements a reed switch, the user can tap sneaker 30 onto a surface. This too will cause current to flow through EL strip 20, thus resulting in illumination, of EL strip 20.

Figure 1C:
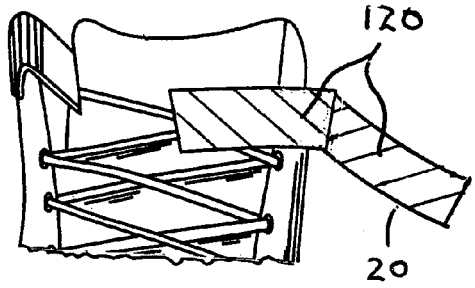
FIG. 1C is an enlarged view of FIG. 1C, showing an embodiment where the attachment clip for the EL strip is Velcro.
Figure 1B:
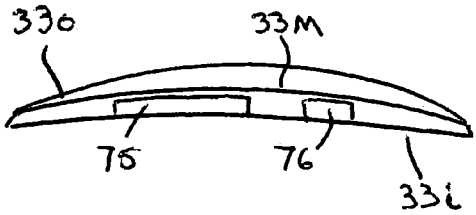
FIG. 1B is a section cut through FIG. 1A, showing the layered substrate materials of the tongue.
Figure 1A:
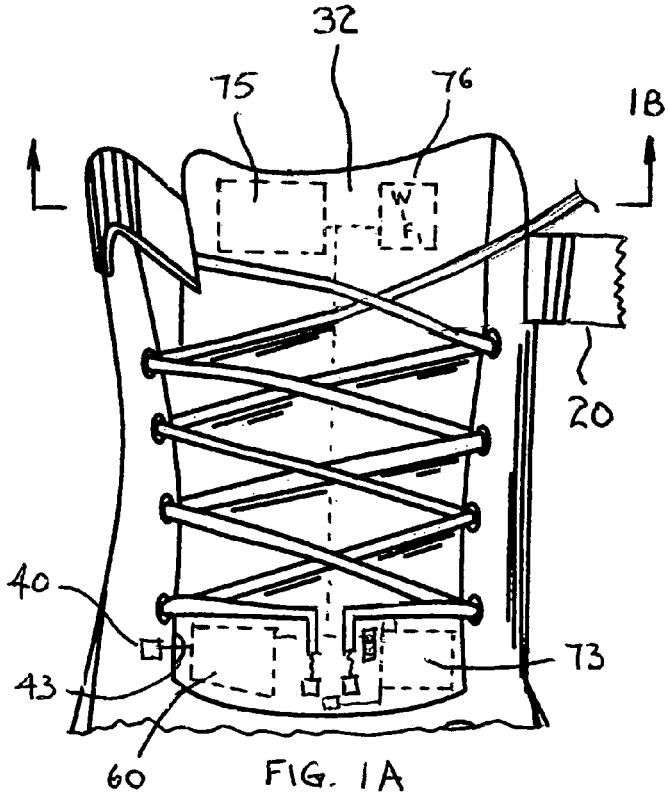
FIG. 1A is an enlarged view of the tongue of FIG. 1, with the electrical components of the current invention shown therein.

In an alternative embodiment EL strip 20 can be attached to the sneaker or other article of apparel via clips or clamps 120. With this embodiment clips or clamps 120 can be located anywhere on the shoe or garment. Clips 120 can be attached to the shoe or garment by any suitable attachment method known in the available market, including, but not limited to sewing, Velcro, glue and the like. Also, clips 120 can be located anywhere on the sneaker or garment. For example, if a sneaker was the article of choice, then clip 120 can be attached to the sneaker by any of the above aforementioned methods, and in any location in the sneaker. Illustrated in FIG. 1C, is the use of Velcro for clip 120 to attach EL strip 20.

As seen in FIG. 2 the sneaker may have a recess 70 in the sole 31, or in the heel 81 of the shoe 80 where a protective box like casing 71 is present. The casing 71 may be any shape or size as long as it fits into the appropriate area of the article to be worn or carried. Inside the casing 71 there is a power switch 72 for activating the device. The power switch 72 is between the power supply 60 and an inverter 73. The inverter 73 is connected to an electroluminescent wire lead 74 that extends from the casing 71. Electroluminescent wire 74 can be secured to the surface of an article of clothing or other article. Alternatively, instead of electroluminescent wiring there can be an electroluminescent cloth such as Lumalive sold by Phillips. The source of power 60 can be a battery, which may preferably be a rechargeable battery.

The invention preferably will have a power switch 72 (on/off. There can also be an option to switch the indicator lights (el wire/el strips/lumalive), to an (on/off/intermittent) setting. In still another embodiment this invention will have the option to switch from an ad hoc mode to an infrastructure mode setting in the communication system. Most installed wireless local area networks (LANs) today utilize "infrastructure" mode that requires the use of one or more wireless access points. Access points are devices that connect wireless communication devices together to form a wireless network. The WAP usually connects to a wired network and can relay data between wireless devices and wired devices. This enables wireless users to utilize corporate servers and Internet applications. "Ad hoc" mode, on the other hand, allows the radio network interface card (NIC) to operate in an independent basic service set (IBSS) network configuration, which has no access points. Devices in ad hoc mode communicate directly with each other in a peer-to-peer manner. In other words, ad hoc mode allows users to spontaneously form a wireless LAN. It may not, however, have access to corporate servers and the Internet that wireless devices in infrastructure mode do have. The most popular example of a wireless device that operates on an ad hoc network is the handheld game console, such as the Playstation Portable and Nintendo DS, which both allow users to connect with each other in ad hoc mode to play video games and even share photos and other files.

There may also be an option to plug in a portable Liquid Crystal Display (LCD) screen (usually, the wire will run to the tongue of the sneakers or elsewhere on the sneakers and the LCD will have the option to be plugged in).

In another embodiment shown in FIG. 3, the article is adapted to send and receive communications including data communications. As seen in FIG. 3, there is a power source 60 which may be a rechargeable battery. The battery 60 powers a motherboard 75 which sends commands to a wireless transmitter 76. There may also be a wireless receiver to facilitate two way communication when the motherboard 75, which includes a memory chip, is prompted to do so. The appropriate signal will cause the electroluminescent material to emit a pattern of light. In a preferred embodiment, the light source will blink on and off, thereby issuing a visual signal that communication was exchanged.

Preferably, the wireless communication device 76 will regularly send out pings or other signals until its connects to the communication device within another similarly equipped sneaker. There may also be an antenna present to extend the range of the devices. There may also be an inverter 73 to power the electroluminescent wire 74 or cloth.

In one embodiment EL strip 20 can be attached to jeans, jackets, hats and the like. For example, if one incorporated the present invention into a hat, EL strip 20 can be designed to follow the brim of the hat. Also, the above invention can be implemented with any type of fabric or material available in the known market. One such fabric that has proven utility with the present invention is Lumalive. Lumalive features flexible arrays of colored light-emitting diodes (hereinafter LEDs) fully integrated into fabrics. These light emitting textiles make it possible to create materials that can carry dynamic messages, graphics, or multicolored surfaces. When the present invention is attached to garments, and/or fabrics, such as drapes, cushions, sofa coverings and the like, which are equipped with Lumalive technology, they will illuminate in order to enhance the observer's mood and positively influence his/her behavior. For example, in one embodiment, which implemented a jacket made with Lumalive, EL 20 was stitched into the back of the jacket in a decorative configuration. With this embodiment the Lumalive jacket was designed to illuminate within the boundaries of EL 20. As will be mentioned below, the power to the EL strips 20 can be controlled via a toggle switch, or any of the aforementioned switches.

With any of the previously mentioned embodiments, computer programs and communication capabilities can be incorporated into the electronic circuitry. For example, in a preferred embodiment there can be a computer program that can be used to store individual data of the user (a profile). The profile can contain, for example, information such as the user's favorite musical genre and the like. This embodiment can also have communication capabilities, similar to the widely used WiFi. Other technologies, similar to that is used in cellphones and satellites, can also be implemented. Thus, when two or more articles of clothing belong to users having common profiles, and are in close proximity, EL strips 20 and/or Lumalive fabric can be designed to illuminate, or play the musical genre associated with the profile, automatically. Conversely, in another embodiment the Lumalive fabric can be designed to illuminate a phrase. Using the scenario as set forth in the previous embodiment, instead of simply illuminating, the Lumalive fabric can display a sentence, such as "Hi my name is Hank, I am a Cancer and I too like Beethoven." These embodiments can also be controlled by any of the previous mentioned activation devices, that is, a toggle switch and the like. The switch in these embodiments can be located in the button of a pocket, or any other suitable location. Also, the WiFi technology implemented can be designed to operate at various ranges, that is, short or long ranges.

In addition, the computer programs that can be utilized with the present invention are endless. For illustrative purposes we discussed the scenario where a computer program that can store user profiles. The present invention can also include a computer program that can alert the user of meetings, appointments, classes and the like. Such alerts can be set and reset periodically by the user.

Another embodiment, similar to the one just mentioned, can be designed with remote control capability. With this embodiment the user can deactivate, or bypass, the computer program, in the event there is a desire not to embark on unwanted conversation.

Although, in the preferred embodiment, the article of clothing itself contains all of the technology necessary to communicate over a WiFi network, in an alternate embodiment, the article of clothing is merely a "base station," which receives signals and downloads files from other users. In this embodiment, the files or signals, may then be transferred automatically to another nearby mobile electronic device, such as a cellular phone, personal digital assistant (PDA), iPod or other mp3 player, or even a laptop computer. In this embodiment, instead of the shoes merely lighting up or sending some signal to the user to notify him of a compatible user profile in the vicinity, a signal is sent from the shoes or other article of clothing, to one of the aforementioned mobile electronic devices, and the electronic device notifies the user of the signal that the article of clothing is sending. This notification system can utilize text messaging, sending a user a message, such as, "User X is a fan of Beethoven, a tennis fan, and enjoys long walks on the beach." Nevertheless, there are virtually limitless possibilities as to how the user can be notified. For instance, alternatively, the electronic mobile device can play the users' shared favorite music or artist or use GPS technology to show the location of the compatible user on a digital map of the immediate area or could show a downloaded picture of the compatible user.

In this same way, the articles can be used by commercial clients to send advertising to potential consumers, and the ad could be sent via text message or e-mail to the mobile electronic device, and the user can have the ability to screen these advertisements before reception. The use of the article of clothing as a base station sending signals and downloaded files to a mobile electronic device may applied in any way practicable to one knowledgeable in the art.

In yet another embodiment EL strip 20 can be designed to accentuate different interior and exterior features of a home. For example, most residential homes have their house number conspicuously located somewhere near the front of their home. The present invention can be designed to follow the contours of the house number. Thus, when the night falls, the number is easily viewable from the curb and/or street.

The EL strips of the present invention can be attached to various other objects and/or clothing locations. For example, EL strip 20 can be attached to novelty flags. In this embodiment EL strip 20 can be attached to the flag in any configuration, and by any of the aforementioned attaching means. Also, kites, flying discs similar to the trademarked "Frisbee" brand, and billboards, are other examples, just to name a few, which can implement the present invention. All of the items just described can be designed to have EL strip 20 attached to the surface by any of the previously mentioned attachment methods. In addition, any of the already discussed methods of activation means can also be implemented. For example, in the instance that a billboard is designed with the present invention, EL strip 20 can be routed to a specific configuration and simply plugged into a separate power supply.

The present invention can also be used with cars. For example, EL strip 20 can be designed around a license plate and fed into the electrical system of the car. In this example EL strip 20 can be controlled by a switch located inside the car, or alternatively by solar power, in which case the surrounding light or lack thereof would activate or deactivate EL strip 20. In another embodiment, EL strip 20 can be designed to accentuate different areas of a car. Or, as in a preferred embodiment, one end of EL strip 20 can be threaded though suction cups and then configured and attached to a window of the car, wherein the other end can be designed to plug into a cigarette lighter. In another embodiment the EL strip may be positioned on or around tail or other lights or connected as part of the utility lights brake/reverse/hazard lights, etc.

In another embodiment, EL strip 20 can be designed to accentuate different parts of a uniform. This is especially valuable for construction workers, police officers, fireman, and the like, where their jobs can sometimes put their safety in a compromised state. For example, construction workers can have EL strip 20 attached to their gear so that they can be seen at night by others.

In less hazardous occupations, EL strip 20 can be implemented to enhance the occupant's apparel. For example, EL strip 20 can be designed into the hat, and/or cape of a magician. Thus adding to the special effects usually associated with this line of work. In this embodiment the present invention can be designed to be controlled via a button in the magician's wand.

As mentioned previously, all the aforementioned articles of apparel can be made with light emitting textiles.

As various changes could be made in the above constructions without departing from the scope of the invention, it is intended that all matter contained in the above description shall be interpreted as illustrative and not in a limiting sense. In the view above it will be seen that several objects of the invention are achieved and other advantageous results attained, as defined by the scope of the following claims.

What is claimed is:

1. An article comprising: a first substrate and a second substrate, each of said substrates having a top surface, a bottom surface, and a perimeter edge surface at least a portion of said first substrate being positioned over a portion of said second substrate such that said bottom surface of said first substrate contacts at least a portion of said top surface of said second substrate, said article further comprising an electroluminescent strip, said strip being positioned such that an outer surface of said strip contacts at least a portion of said first substrate, said electroluminescent strip comprising one or more of a fabric and a wire, said electroluminescent strip being operatively connected to a power source and a switch for activating said strip, said article further comprising a mobile computing device using wireless local area networks, said computing device being capable of storing personal data and creating a profile of said user, said profile comprising one or more of music, food, and movies, and wherein when said article is within a certain range of a second article, with said second article having its own profile, said mobile computing device of each article causing respective computing devices to exchange at least a portion of said data in said profile of each article, and signal that said profile is being exchanged.

2. The article according to claim 1 wherein at least a portion of the outer surface of said strip contacts said edge of said first substrate and at least a portion of the top surface of said second substrate.

3. The article according to claim 1 wherein said article is an article of clothing.

4. The articles according to claim 3 wherein the article of clothing is a footwear.

5. The article according to claim 4 wherein a portion of said footwear is manufactured from a light emitting textile.

6. The article according to claim 4 wherein said footwear has apertures for threading a shoelace therethrough, said electroluminescent strip being threaded through said apertures.

7. The article according to claim 1 wherein said power supply is operatively connected to said computing means, said computing means controlling the illumination of said electroluminescent strip.

8. The article according to claim 1 wherein said power supply is operatively connected to said computing means said computing means controlling the illumination of said electroluminescent fabric.

9. The article according to claim 8 wherein said computing means is programmed to display one or more alphanumeric characters.

10. The article according to claim 1 wherein said computing means is programmed to alert the user at specific times.

11. The article according to claim 10 wherein said computing means has a remote control bypass.

12. The article according to claim 11 wherein said remote control bypass is located in a button on said user.

13. The article according to claim 1 further comprising a communication system that permits one article to communicate with another article.

14. The article according to claim 13 wherein the communication system includes at least one transmitter on one article and at least one receiver on a second article.

15. The article according to claim 14 wherein said articles are footwear.

16. The article according to claim 15 further comprising a motherboard.

17. The article according to claim 16 further comprising a power inverter.

18. The article according to claim 17 wherein said footwear has an electroluminescent fabric thereon.

19. The article according to claim 18 wherein said communication system in said article automatically connects to the communication system in other articles.

20. The article according to claim 19 wherein said communication system automatically connects to an access point via wireless or wired network.

21. The article according to claim 20 wherein said communication system sends information to a computer.

22. The article according to claim 21 wherein said communication system sends information a website.

23. The article according to claim 1 wherein said personal data includes at least a device identification number.

24. At least a first and a second article of footwear with each comprising: an upper member and a sole/heel member, a motherboard, and a power inverter, and at least a portion of said footwear having and an electroluminescent material secured thereto, said electroluminescent material comprising one or more of electroluminescent fabric and electroluminescent wire, said electroluminescent material being operatively connected to a power source and a switch for activating said material, said article further comprising a communication system that permits said first article to communicate with said second article, said communication system comprising at least one transmitter and at least one receiver on each of said at least a first and second article of footwear; said electroluminescent material becoming illuminated when said receiver receives a signal from a transmitter not present on said at least a first and second article of footwear; said at least a first and second article further comprising a mobile computing device, said mobile computing device being capable of storing personal data and a profile of said user, said personal data comprising data about said user including one or more of personal, business, advertising, classified, and recreational data; and wherein when said first article is within a certain range of said second article, each of said mobile computing devices of said at least a first and second article exchange at least a portion of said data therebetween, and with a signal being provided that said profile is being exchanged.

25. An article of footwear comprising: an upper member and a sole/heel member, at least a portion of said footwear having and an electroluminescent material secured thereto, said electroluminescent material being operatively connected to a power source and a switch for activating said material, said article further comprising a mobile computing device and a communication system, said mobile computing device storing personal data in a profile of the user, said communication device permitting said article to communicate with a second such article, and wherein when said article is within a certain range of said second article, said second article having its computing device with its own profile, said mobile computing device of each article causing communication therebetween, said communication comprising said computing device of each article exchanging at least a portion of said data therebetween and signaling that said profile is being exchanged.

26. The article according to claim 25 wherein the communication system includes at least one transmitter on one article and at least one receiver on a second article.

27. The article according to claim 26 wherein said article of footwear has a transmitter and a receiver.

28. The article according to claim 27 wherein said electroluminescent material becomes illuminated when said receiver receives a signal from a transmitter not present on said article of footwear.

29. The article according to claim 28 further comprising a motherboard.

30. The article according to claim 29 further comprising a power inverter.

31. The article according to claim 30 wherein said article of footwear has an electroluminescent fabric thereon.

32. The article according to claim 31 wherein said article of footwear has an electroluminescent wire thereon.

33. The article according to claim 32 wherein said personal data comprises one or more of personal, business, advertising, classified, recreational data about a user.

34. An article comprising: a first substrate and a second substrate, each of said substrates having a top surface, a bottom surface, and a perimeter edge surface, at least a portion of said first substrate being positioned over a portion of said second substrate such that said bottom surface of said first substrate contacts at least a portion of said top surface of said second substrate, said article further comprising an electroluminescent strip, said strip being positioned such that an outer surface of said strip contacts at least a portion of said first substrate, said electroluminescent strip being operatively connected to a power source and a switch for activating said strip, said article further comprising a mobile computing device using wireless local area networks, said computing device storing personal data in a user profile, and wherein when said article is within a certain range of a second article, said second article having its own profile, said mobile computing device of each article causing said computing device to exchange at least a portion of said data in said profile of each of said articles, and signal that said profile is being exchanged.

* * * * *